343-756 SR
4/7/81 OR 4,260,991

United States Patent [19] [11] 4,260,991
Dachert et al. [45] Apr. 7, 1981

[54] LUNEBERG TYPE PASSIVE REFLECTOR FOR CIRCULARLY POLARIZED WAVES

[75] Inventors: Francois Dachert; Jean Gelin; Raymond Ropars, all of Paris, France

[73] Assignee: Societe Lignes Telegraphiques et Telephoniques, Conflans-Sainte-Honorine, France

[21] Appl. No.: 60,201

[22] Filed: Jul. 24, 1979

[30] Foreign Application Priority Data

Aug. 4, 1978 [FR] France ..... 78 23055

[51] Int. Cl.[3] ..... H01Q 15/08
[52] U.S. Cl. ..... 343/756; 343/911 L
[58] Field of Search ..... 343/756, 911 R, 911 L, 343/753, 754, 755

[56] References Cited

U.S. PATENT DOCUMENTS 2,989,746 6/1961 Ramsay ..... 343/756
3,015,102 12/1961 Crane et al. ..... 343/911 L
3,047,860 7/1962 Swallow et al. ..... 343/915
3,119,109 1/1964 Miller et al. ..... 343/756

FOREIGN PATENT DOCUMENTS 1238970 12/1961 Fed. Rep. of Germany ..... 343/911 L

*Primary Examiner*—Eli Lieberman
*Attorney, Agent, or Firm*—Kemon & Estabrook

[57] ABSTRACT

A luneberg type passive reflector for circularly polarized waves consists of a woven cloth made partially of conductive wires located within the dielectric sphere the surface of which is covered with a set of parallel wires perpendicular with the conductive wires in said cloth. The conductive wires of the cloth are less than five hundredths of wavelength in diameter and their spacing is between ¼ and 1/20 of a wavelength. The wires interwoven with said metal wires to form the cloth are preferably made of flax.

4 Claims, 6 Drawing Figures

LUNEBERG TYPE PASSIVE REFLECTOR FOR CIRCULARLY POLARIZED WAVES

BACKGROUND OF THE INVENTION AND PRIOR ART

The present invention concerns passive reflectors for electromagnetic waves and more particularly passive reflectors of the Luneberg type. Such reflectors are well known to the person skilled in the art. They consist essentially of a dielectric sphere of which the index varies along a radius in accordance with a known law and which has on part of its surface a metallic coating serving to reflect the incident energy. Such a reflector has been described notably in U.S. Pat. No. 3,204,244 issued on June 25, 1963 and assigned to the same Assignor as the present application. These reflectors operate on rectilinearly polarized plane waves.

Such reflectors are often used to increase the equivalent surface of the targets employed for the purpose of monitoring the performances of radar systems, because they have a considerable equivalent surface with a small mass and an angular aperture which can be very considerable. Present-generation radar systems exit circularly polarized waves, inter alia for reducing the effects of raindrops. It is therefore necessary to provide targets which are capable of reflecting circularly polarized waves. It is known that a metallic surface reflects a circularly polarized wave in the form of a circularly polarized wave having a reverse direction of rotation. Taking into account the conventions employed to define the direction of rotation of circularly polarized waves (trirectangular trihedron of which the axis Ox is directed in the sense of the propagation), the electric fields of the transmitted and reflected waves are in phase opposition and the reflector transmits a reflected wave polarized at 90° to the incident wave, which will not propagate in the transmitter-receiver waveguide. It is therefore impossible to use Luneberg reflectors designed for rectilinearly polarized waves to reflect circularly polarized waves.

It has been proposed (see French Pat. No. 1,202,058 filed Sept. 9, 1958) to produce a reflector by applying a series of wires mounted on combs to a viscous material maintained in a mould and subsequently hardened and released from the mould. Such a structure is unsuitable for the reflection of circularly polarized waves because it involves an attenuation of 6 dB, only half the energy being reflected.

There have also been proposed reflectors for circularly polarized waves, notably in French Pat. No. 1,192,598, which consists of plane conductive panels formed with parallel grooves or corugation constituting a reflecting trihedron whose aperture angle is very small.

U.K. Pat. No. 984,144 assigned to TELEFUNKEN discloses a Luneberg reflector for circularly polarized waves comprising a parallel wire grid located preferably at $n\lambda/8$ or $n\lambda/4$ in front of the reflection means wherein the gap between the grid wires is smaller than $\lambda/2$. This patent gives no practical way of producing said reflector and more particularly of laying the grid wires on the inner dielectric sphere.

U.S. Pat. No. 2,989,746 assigned to MARCONI WIRELESS TELEGRAPH COMPANY discloses a scanning antenna system for linearly polarized waves which uses a partially reflecting coating on a complex hollow surface of revolution made of ringlike sections.

According to FIG. 3, the coating may consist in a woven cloth made of glass and metal wires at 45° to the length of the step when flat.

It is an object of the invention to provide means to produce wide aperture Luneberg reflectors the aperture of which may be readily adjusted and larger than 120°.

It is another object of the invention to provide Luneberg reflectors for circularly polarized waves the equivalent surface of which is equal to that of a reflector of the same dimension for linearly polarized waves. It is another object of the invention to provide a reflector for circularly polarized waves the weight of which is almost equal to that of a reflector for linearly polarized waves.

BRIEF SUMMARY OF THE INVENTION

The Luneberg reflectors according to the present invention comprise the following elements:

a dielectric sphere having an index n which is variable as a function of the distance from the centre approximately in accordance with the Luneberg law $$n = \sqrt{2 - \left(\frac{R}{R_o}\right)^2}$$

where R is the distance from the centre and $R_o$ the radius of the reflector,

A first set of equidistant parallel conductors whose spacing is between $\lambda/4$ and $\lambda/20$ and whose diameter is equal to few hundredths of $\lambda$, constituting a first reflecting surface situated on a portion of the internal sphere of radius $$R_0 - \left(\frac{\lambda}{4} + n\lambda\right)$$

where n is a positive integer or zero and $\lambda$ the wavelength, a second conductive surface disposed outside the sphere and subtending an angle at least equal to that of the set of conductors of the first surface and comprising at least one set of conductors perpendicular to those of the first of equidistant parallel conductors.

In accordance with a preferred embodiment of the invention, the first set of parallel conductors belongs to a weave, of which it constitutes at least partially either the weft or the warp, the weave being completed by dielectric textile threads and the second conductive surface is a conductive coating on the inner face of a radome surrouding the reflector.

The reflectors according to the invention have the following advantages:

introducing conductive wires on a portion of the internal sphere does not afford any particular difficulty, since Luneberg lenses are industrially produced from a series of half-shells fitting one upon the other and around a central core. Since the half-shells are obtained by moulding, their thickness can be precisely controlled and thereby the spacing between the two reflecting surfaces.

BRIEF DESCRIPTION OF THE DRAWINGS

The invention will be readily understood from the following description and by reference to the accompanying FIGS. 1 to 4, which are given by way of non-limiting illustration and in which.

DETAILED DESCRIPTION OF THE INVENTION

Figure 1:
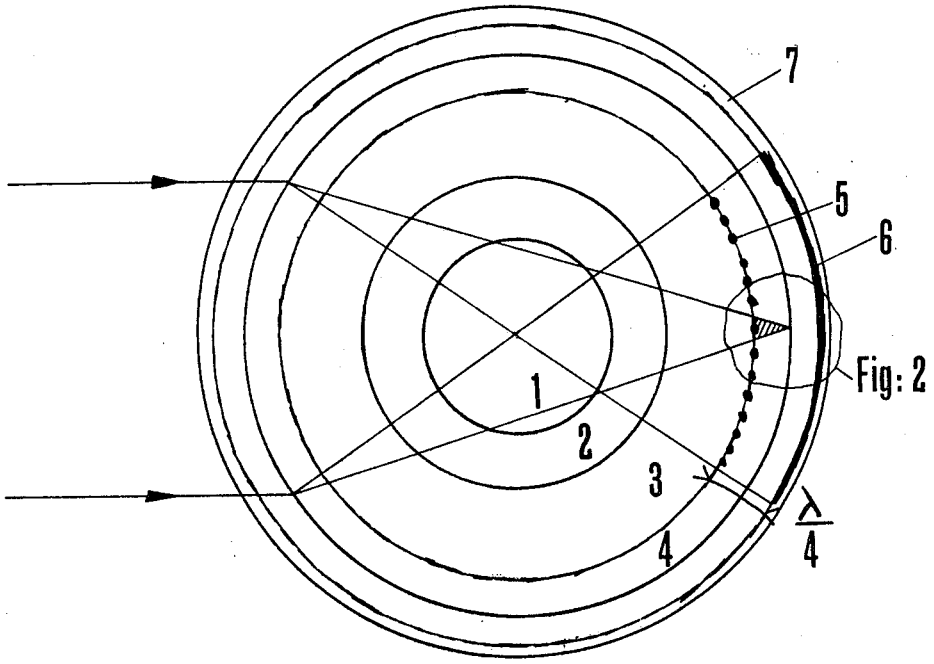
FIG. 1 is a diagrammatic sectional view of a reflector according to the invention.

FIG. 1 is a diagrammatic sectional view of a reflector according to the invention. As is shown, it is composed essentially of three concentric layers 2, 3, 4 of dielectric of suitable index around a spherical core 1. The number of successive layers used depends upon the performances of the reflector and upon the nature of the dielectric. In accordance with the invention, there is disposed between the two outer layers 3 and 4 grating of parallel wires 5 (perpendicular to the sectional plane) and, outside the last layer, a second grating of parallel wires 6 orthogonal to the preceding ones (one of which is in the sectional plane). The thickness of the layer 4 is equal to $\lambda/4$, where $\lambda$ is the wavelength in the material of which it consists. A radome 7 is usually disposed around the reflector to protect it mechanically. The angles at the center subtended by the gratings 5 and 6 are equal.

Figure 2:
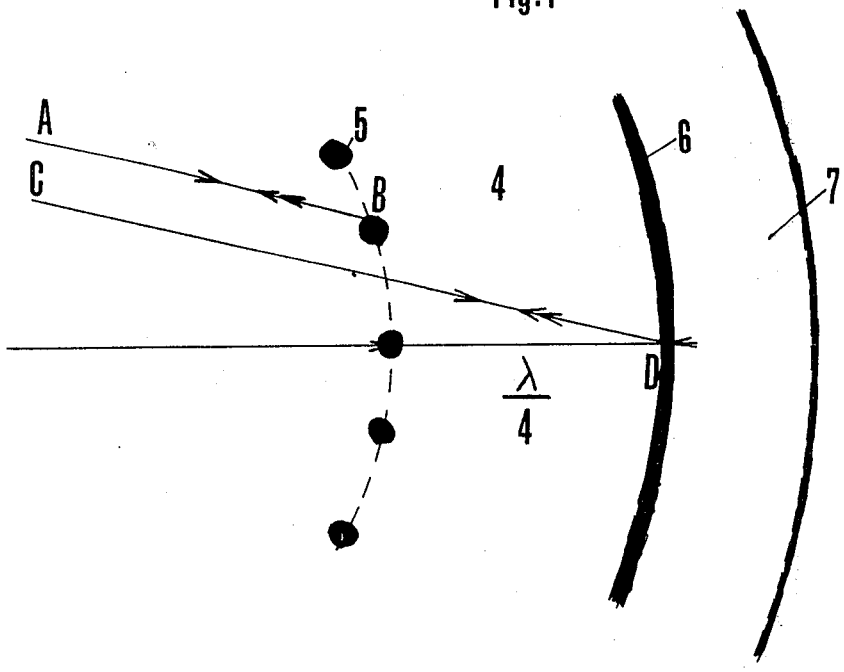
FIG. 2 is an enlarged diagram explaining the reflection of a circularly polarized wave by the said reflector.

The reflector operates as follows (cf. FIG. 2): a circularly polarized incident wave consists of two rectilinearly polarized waves whose respective electric fields are parallel to the wires of the grating 5 (shown at AB) and those of the grating 6 (shown at CD). The component AB is entirely reflected by the wires 5. The component CD is integrally transmitted by the wires 5 and reflected by the grating 6. The wave reflected by 6 passes without attenuation through the grating of wires 5 and combines with the wave reflected by the latter. At the front of the reflector the two orthogonal rectilinearly polarized waves reconstitute a circularly polarized reflected wave. Owing to the additional path of one of the components of $\lambda/2$ (forward and return travel through the layer 4), the direction of rotation of the circularly polarized wave is reversed and, taking into account the conventions referred to in the foregoing, the reflected wave will be transmitted through the transmitting polarizer and the wave guide of the source of the transmitted waves towards the associated receiver. In the case where the source is a radar transmitter, the reflected wave is therefore given a direction of rotation which permits its reception by the associated receiver. The additional attenuation due to the travel through the layer 4 is negligible and the reflection introduces substantially no ellipticity, as has been confirmed by experiment.

In order that the reflection may be effected in the form of a circularly polarized wave with a maximum angular aperture, it is important that the following conditions should be satisfied:

(1) the conductors 5 remain parallel (2) the conductors 5 follow the shape of the layer 4

(3) the distance between two conductors 5 remains small as compared with the wavelength (of the order of 1 to 2 tenths of the latter).

In order that the second reflection may be ensured, the wires 6 must be perpendicular to the wires 5. In practice, the reflection of the first component may be regarded as total if the conditions relative to the first reflection are satisfied. Under these conditions, the wires 6 are advantageously replaced by a continuous metallization on the inside face of the radome 7 which obviously results in a simplification of the production process.

Figure 5:
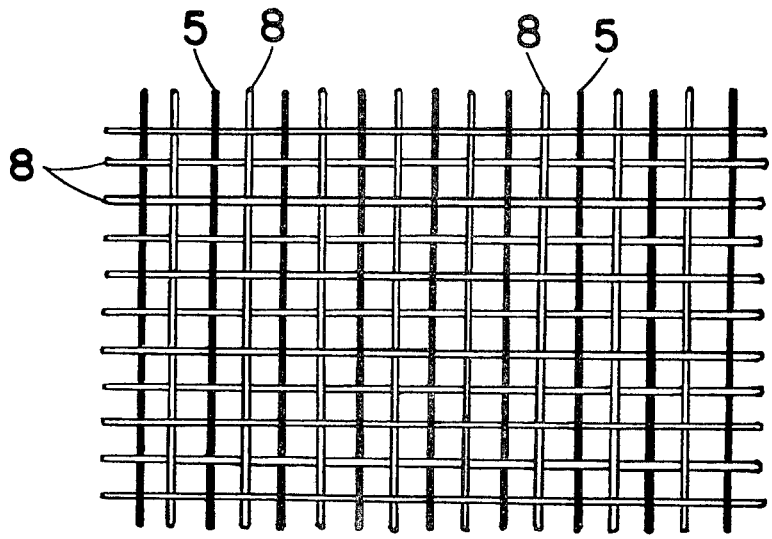
FIG. 5 is a plan view of a textile and wire woven cloth applicable to one of the concentric layers to form a reflector.

The grating 5 as shown in FIG. 5 is produced by weaving metal wires on a warp of textile fibers 8 and applying the woven fabric to the layer 3 in accordance with the dome of desired angle. The woven fabric is adhesively secured to its periphery to the dielectric shell 3. This solution makes it possible to spare any machining step of the shells once manufactured. The conditions which must be satisfied by the conductors 5 involve proper selection of the weaving operation parameters as follows:

- the nature of the textile fiber is chosen as a function of the elasticity of the conductor wire so as to avoid any permanent deformation of the latter due to weaving:
- the cohesion of the woven fabric is ensured by interposing texile filaments between the conductor wires;
- the positioning of the piece of woven fabric on the sphere must be such as to ensure parallelism of the conductors and the woven fabric must follow the shape of the sphere 3.

With regard to the nature of the textile fibres, it only has a mechanical function for avoiding deformation of the metal wire. Good results have been obtained at 15.5 GHz by using an enamelled brass wire of a diameter of 0.25 mm woven on a flax warp with a pitch of 2.7 millimeters, two flax filaments being disposed between each pair of conductor wires to ensure cohesion of the fabric. The diameters of the textile filaments and the conductor wires are approximately the same. The diagrams of FIGS. 3 and 4 corresponds to this embodiment. A fabric comprising a completely metallic weft has too much rigidity to adapt itself to the shape of the sphere on which the fabric must rest when applied by permanent deformation. Experiments have shown that cotton is also suitable in the case of enamelled brass. Like flax, cotton deforms to constitute the fabric, the conductors remaining rectilinear. On the other hand, tests made with 0.15 mm silver-coated copper wire have given poor results, because the conductor wire deforms in the course of the weaving. Any deformation of the conductor wire results in a reduction of the gain of the reflector, which cannot be compensated for by an increase in the conductivity of the wire. The above values are not critical. More particularly, a fabric comprising a flax warp and a weft consisting of alternate flax and enamel-coated copper wires of 0.25 mm has given good results. The pitch of the conductors in this case is 2mm. The minimum value of the pitch is fixed by the mechanical properties of the woven fabric. With regard to the diameter of the conductors, the minimum value is fixed by the condition of non-deformation of the conductor by weaving. The maximum value of the diameter is fixed by the electrical performances of the reflector. At excessively high values, the gain decreases.

The thickness of the layer 4 is not a very critical parameter. It is about one-quarter of the wavelength. The important condition to be met is the electrical distance between the two metallizations. Experiments have shown that the grating of wires 5 behaves as an impedance difference from that of the dielectric propagation medium and that the distance between the two layers must be less than one-quarter the wave-length in order to compensate for the impedance discontinuity due to the wires . For example, at 15.5 GHz, the optimum distance between the two reflecting surfaces has been found to be 4.5 millimeters when the permittivity of the intermediate medium is between 1.10 and 1.20. Experiments have shown that a distance of 4 millimeters gives equivalent performances, but a reduction to 3 millimeters is sufficient to bring about a reduction of the gain. Likewise, an increase in this distance also decreases the gain, but more slowly. A distance of 6 millimeters makes the reflector almost useless. A compromise may be obtained between the distance of the two surfaces and the permittivity of the intermediate medium. The latter does not affect the position of the focus of the reflector.

An important factor in the good operation of the reflector is the adhesion of the fabric to the spherical surface 3. Poor adhesion results in the interposition of a wedge of air, which is cause of rapid gain loss.

Figure 3:
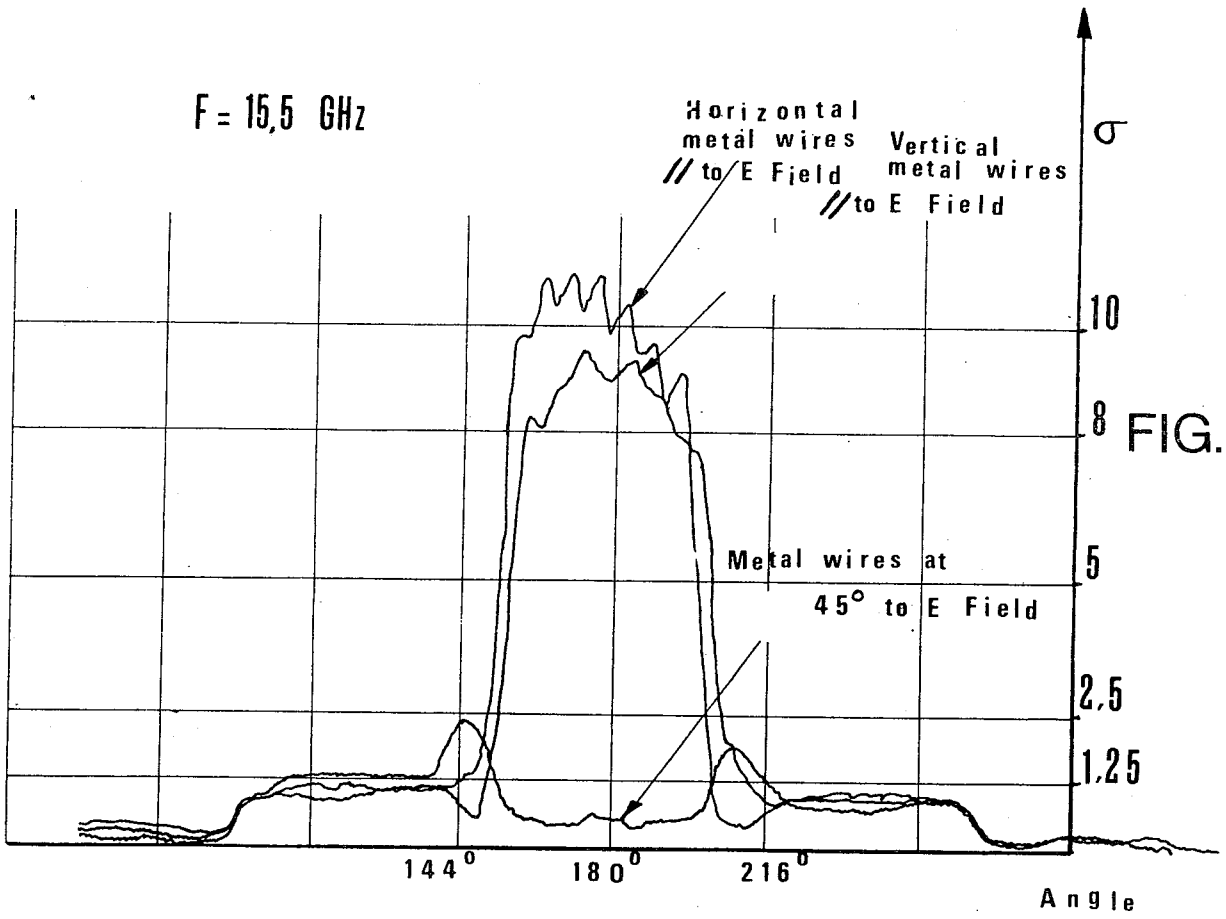
FIGS. 3 and 4 are radiation diagrams of two variants of the invention.

The focus of the lens is slightly displaced by the presence of the grating of wires 5 and a displacement of the focus, moving it away from the center of the sphere is noted. This displacement may be compensated for by an increase of the permittivity of at least a part of the layer 3 supporting the grating 5 in relation to the value expected in the absence of the grating of wires. By way of example, a reflector operating in the Ku band has been produced giving the pattern of FIG. 4, using a layer having a permittivity of 1.2 $\epsilon_4$ supporting the grating 5 and the metallisation 6 applied to the internal face of the radome. In the absence of 5, the layers 3 and 4 are unique and have a permittivity $\epsilon_4$ this corresponds to 1.2 times the value given by Luneberg's law. In the construction corresponding to the diagrams of FIGS. 3 and 4, $\epsilon_4 = 1.13$. The dome angle in the embodiment corresponding to FIG. 3 is 50°. It is 120° in the embodiment corresponding to FIG. 4. All the other parameters are identical. It can be seen in the diagrams that the equivalent surface is slightly higher for the smaller aperture reflector (FIG. 3). This characteristic is well known from the man of art. The two above examples are not to be considered as limitative. Some designs have been made with an angular aperture of 140°.

In the foregoing, it has been assumed that the reflector is of the monostatic type, that is to say that the focus is on the second reflecting surface. It is to be understood that the invention makes it possible to produce bistatic reflectors by an appropriate choice of the indices of the layers. Likewise, the reflecting dome at 5 and 6 may be replaced by a belt, as described in the aforesaid U.S. Pat. No. 2,989,746 when the corresponding pattern is suitable for the user.

FIG. 3 illustrates the characteristic of such a reflector in relation to an incident wave rectilinearly polarized in parallel relationship to the wires 5 extending in two orthogonal directions (curves A and B) and at 45° in relation to the electric field (curve C). The ordinates are proportional to the equivalent surface or to the gain of the reflector and the abscissae to the aperture. This reflector has an aperture of about 50° and a maximum equivalent surface of 10.5 $m^2$.

Figure 4:
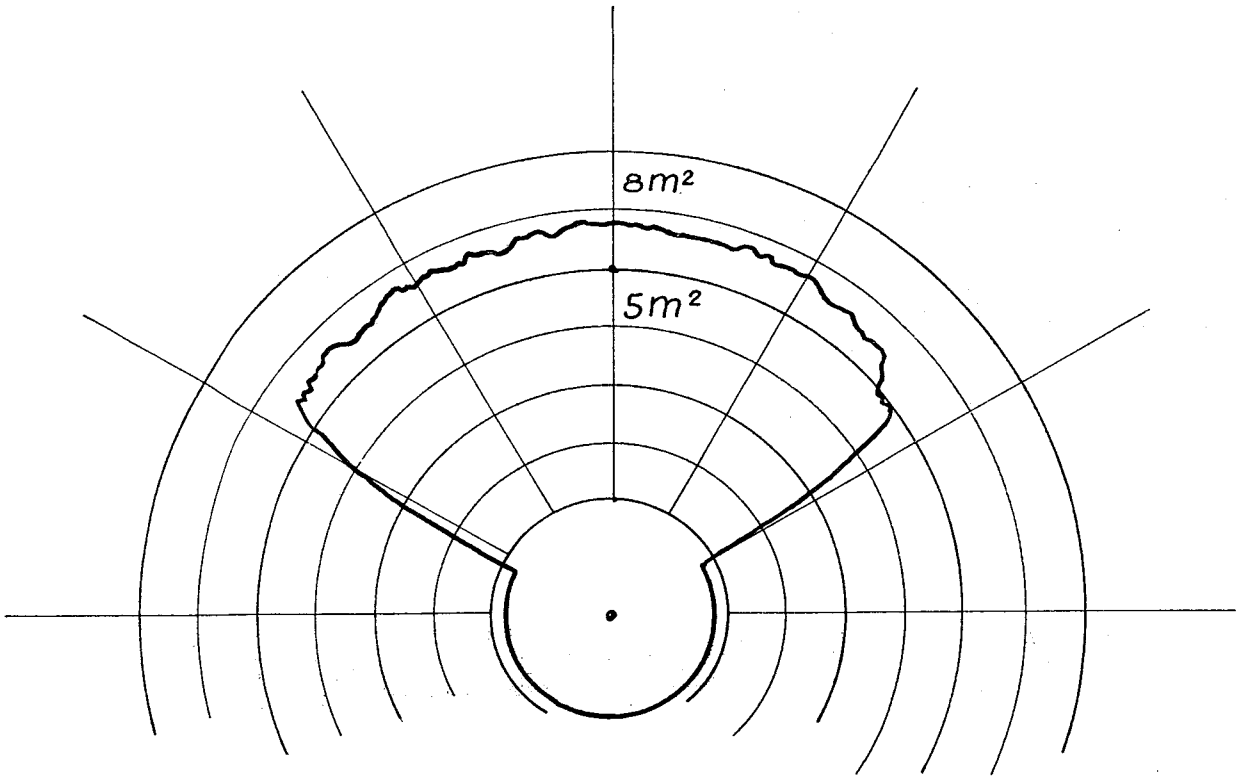

FIG. 4 illustrates, in polar coordinates, the equivalent surface of a (120° aperture) reflector with an equivalent surface over 7.5 $m^2$. Each radial line in the figure is 30° away the adjacent lines. The design of such a reflector has been already described.

Figure 6:
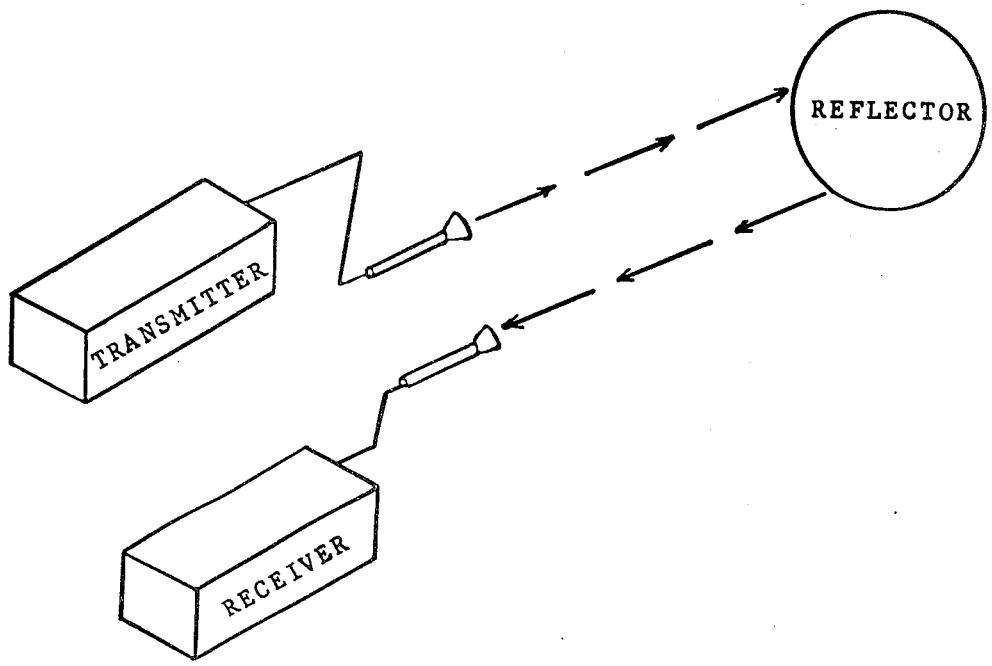
FIG. 6 is a diagrammatic illustration of the use of the present invention.

FIG. 6 merely shows the positioning of the reflector of the present invention so as to receive a circularly polarized incident wave emitted by a transmitter, such as a radar transmitter, and the reflected wave is received by an associated receiver as is well known to those skilled in this art.

What we claim is:

1. A wide angular aperture Luneberg type reflector for circularly polarized waves comprising:

a spherical core;

a plurality of concentric dielectric shells disposed around said spherical core the index of said core being selected according to the Luneberg Law;

a protective radome disposed around the ultimate external shell;

a piece of woven cloth adhesively secured to a portion of the penultimate shell and including a warp and a weft, said warp comprising flax textile threads and said weft comprising parallel enameled copper wires alternately separated by textile threads; and a continuous conductive coating deposited on at least a part of the inner face of said radome, said piece of woven cloth being located one quarter wavelength apart from said conductive coating.

2. A wide angular aperture Luneberg type reflector as claimed in claim 1 wherein said outer shell of said reflector and said inner face of said radome are separated by an air filled space.

3. A wide angular aperture Luneberg type reflector as claimed in claim 1 wherein the diameter of said metal wires is smaller than five hundredths of the wavelength at the reflector operating frequency and their spacing is between $\frac{1}{4}$ and 1/20 of said wavelength.

4. A wide angular aperture Luneberg type reflector as claimed in claim 2 wherein the index of said penultimate shell is up to 20 percent higher than the value given by the Luneberg Law.

* * * * *